United States Patent [19]

Hostatter et al.

[11] Patent Number: 4,594,219

[45] Date of Patent: Jun. 10, 1986

[54] POWDER METAL CONSOLIDATION OF MULTIPLE PREFORMS

[75] Inventors: Alfred F. Hostatter, Dana Point; Wayne P. Lichti, Lakewood; John G. Papp, Yorba Linda, all of Calif.

[73] Assignee: Metals, Ltd., Newport Beach, Calif.

[21] Appl. No.: 761,845

[22] Filed: Aug. 2, 1985

[51] Int. Cl.[4] ..... B22F 7/00

[52] U.S. Cl. ..... 419/8; 29/DIG. 48; 148/127; 156/308.2; 156/308.6; 156/309.3; 228/193; 228/194; 228/195; 228/196; 228/903; 419/9; 419/48; 419/49; 419/51

[58] Field of Search ..... 419/36, 37, 48–52, 419/8, 9; 29/DIG. 48; 148/127; 156/308.2, 308.6, 309.3; 228/193, 194, 195, 196, 903

[56] References Cited

U.S. PATENT DOCUMENTS 4,141,482 2/1979 Reynolds ..... 419/6

4,485,961 12/1984 Ekbom et al. ..... 419/49

*Primary Examiner*—Stephen J. Lechert, Jr.

*Attorney, Agent, or Firm*—William W. Haefliger

[57] ABSTRACT

The method of producing a metallic, ceramic, or metal ceramic, part, employing powdered material, that includes:

(a) forming two or more oversize powder material preforms respectively corresponding to two or more sections of the ultimate part to be produced, (b) placing said preforms in side-by-side relation, and (c) consolidating said preforms at elevated temperature and pressure to weld said sections together and to reduce the sections to ultimate part size.

29 Claims, 16 Drawing Figures

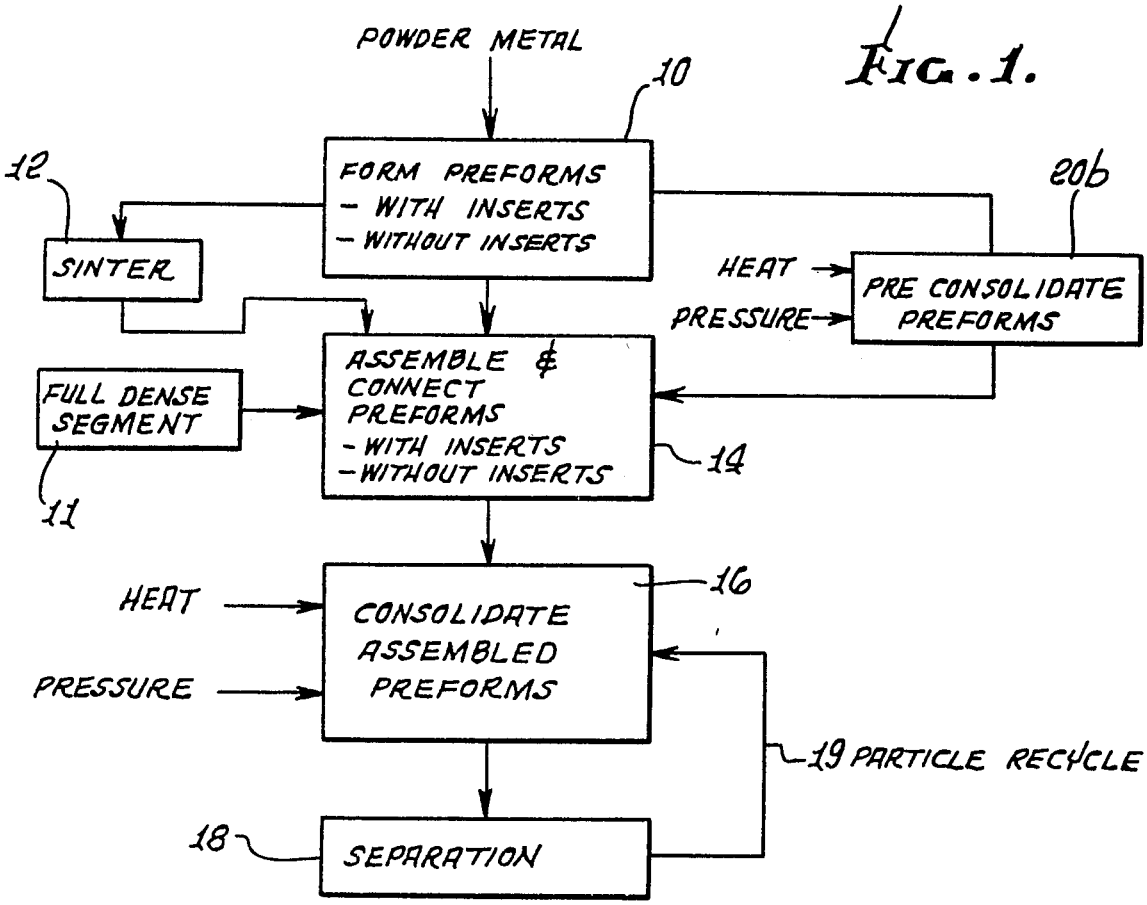
FIG. 1.
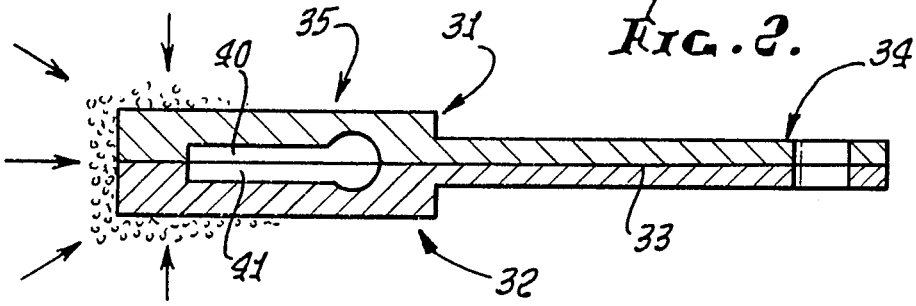
FIG. 2.
FIG. 2a.
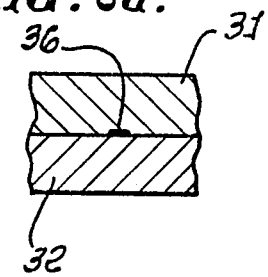
FIG. 2b.
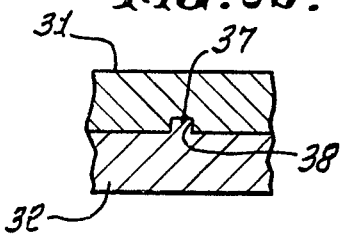
FIG. 2c.
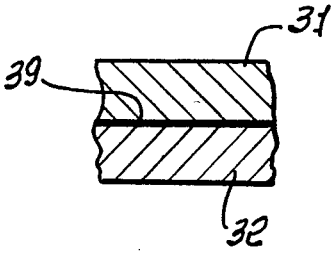
FIG. 2d.
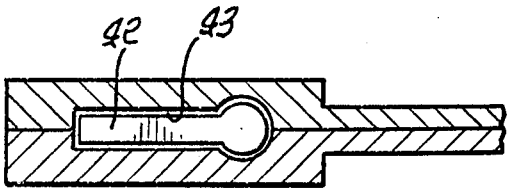

POWDER METAL CONSOLIDATION OF MULTIPLE PREFORMS

BACKGROUND OF THE INVENTION

This invention relates generally to consolidation of powder metal or ceramic parts to a range of 90% to full density, and particularly parts comprising complex or compound shapes.

Attempts to employ powder metal and ceramic consolidation technology in the production of acceptable parts having such shapes have proved difficult and elusive. Typical of such parts are those having complex cross section or sections with undercuts such as H shapes, and/or with holes through the resultant parts. Examples are connecting rods for machines, and hand wrenches, there being many other of similarly complex shape. However, the advantages of powder metal technology are considerable, and there is great need for improved techniques to enable formation of such consolidated metal parts and ceramics.

SUMMARY OF THE INVENTION

It is a major object of the invention to provide methods meeting the above need. Basically, the method of the invention contemplate formation of two or more oversize preforms comprising sections of the resultant part to be produced, joining such sections, and then consolidating the joined sectons at elevated temperature and pressure in such a way as to increase their densities by overall size reduction, and to weld them together.

As will appear, the oversize preforms may be joined in side-by-side relation, as by adhesive bonding, tack welding or by local mechanical means; loose metal powder may be placed in a thin layer between the preforms to consolidate therewith and aid their mutual welding; a recess or recesses may be formed in one or more of the preforms to accept an insert or inserts to be maintained therein during consolidation; and the preforms may have the same or different metallic or ceramic compositions.

A further object is to include a pre-consolidating step wherein the preforms are partially reduced in size prior to their joining in side-by-side relation for subsequent and final consolidation.

A still further object of this invention is to establish a simplified method for producing a part or parts that contain lateral or oblique holes, or slots, or pockets, in the final part, such openings being at a 90° angle, or an oblique angle, relative to the direction of pressing of the part in the consolidation process. In analyzing the final configuration of a part that is to contain a lateral or oblique pocket, hole, or slot the part is bisected along a plane that intersects the opening described. In preparing the preforms for such a part, such preforms are formed as segments of the final part, each segment to contain half or nearly half of the previously described slots, pockets, or holes. This technique greatly simplifies and improves the quality of the preforms, both in uniformity of density and shape control. For example, if a preform is cold pressed in one piece with a lateral feature or cavity in it, (i.e. an undercut slot or hole) a die core insert must be used to form such cavity. It is difficult to get uniform density of the preform powder around such an obstruction in the die cavity. By splitting the cavity or feature and making the preform in two or more sections bisecting the feature, the quality (uniformity of density) of the preform is improved. Subsequent assembly, placement of an insert, consolidation and bonding of the part, produces a quality finished product, with the previous multi-sectioned preform now becoming an homogeneous one-piece part. After consolidation, the inserts can be removed by chemical leaching or mechanical displacement.

Both pre-consolidation and ultimate consolidation steps may be carried out in a bed or beds of hot grain (as for example ceramic or carbonaceous particles) to which pressure is transmitted, as will appear.

These and other objects and advantages of the invention as well as the details of an illustrative embodiment, will be more fully understood from the following specification and drawings, in which:

DRAWING DESCRIPTION

FIG. 1 is a flow diagram showing method steps of the invention;

FIG. 2 is a section showing preform sections in assembled relation;

Figure 3:
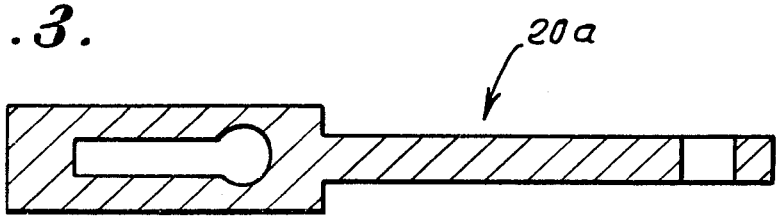
Figure 4:
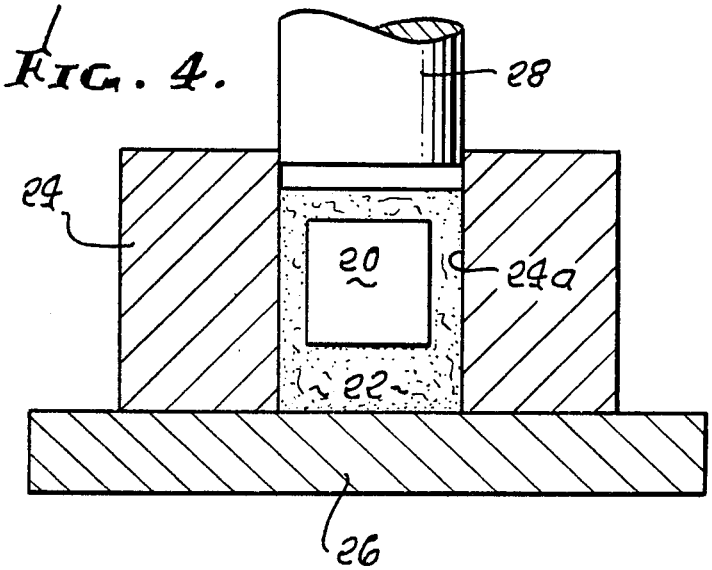
Figure 5:
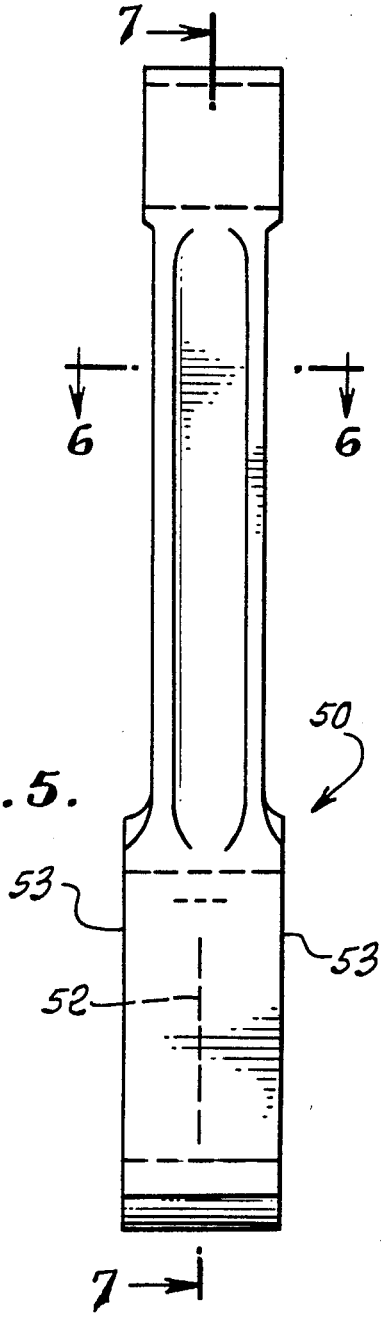
Figure 6:
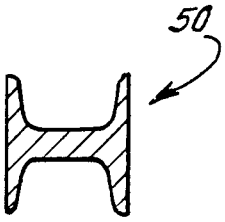
Figure 7:
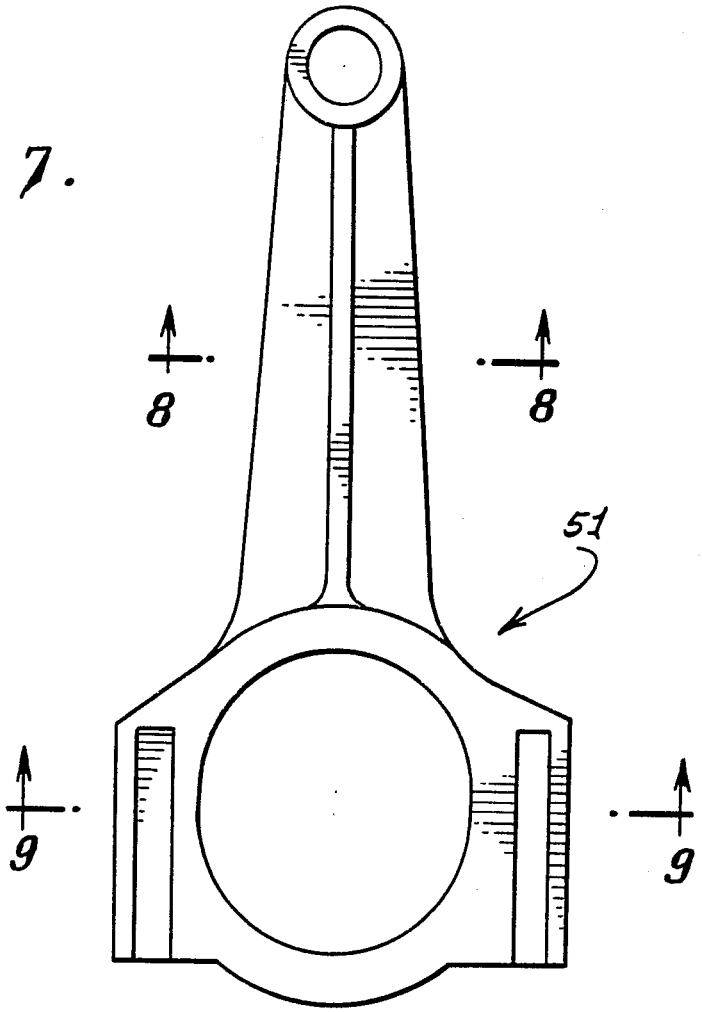
Figure 8:
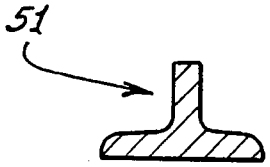
Figure 9:
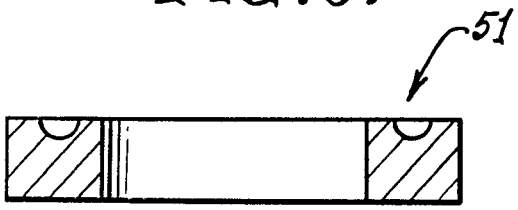
Figure 10:
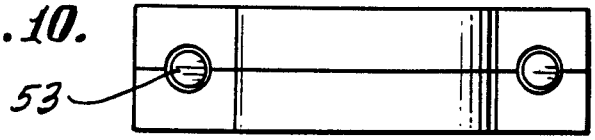

FIGS. *2a–2d* are fragmentary sections illustrating methods of preform interconnections;

FIG. 3 is a section like FIG. 2, but showing a consolidated part;

FIG. *3a* is perspective view of a consolidated wrench, and FIG. *3b* is a view of the wrench head, prior to assembly;

FIG. 4 is a cut-away view showing the consolidation step of the invention;

FIG. 5 is an elevation showing a connecting rod from one edge;

FIG. 6 is a section on lines 6—6 of FIG. 5;

FIG. 7 is a frontal elevation showing half of a consolidated connecting rod, i.e. a preform;

FIGS. 8 and 9 are sections taken on lines 8—8 and 9—9 of FIG. 7; and FIG. 10 is an end view of an assembled connecting rod.

DETAILED DESCRIPTION

Referring first to FIG. 1, there is shown a flow diagram illustrating the method steps of the present invention. As can be seen from numeral 10, initially metal, metal-ceramic, or ceramic parts or particles of manufacture or preforms are made, for example, in the shape of portions of a wrench or other body. While the preferred embodiment contemplates the use of metal preforms made of powdered steel particles, other metals and metal alloys, and ceramic materials such as ferrite, silicon nitride, alumina, silica and the like are also within the scope of the invention.

Typical steel preform compositions consist of iron alloyed with nickel and molybedenum as follows:

iron between 96 and 100 wt. %
nickel between 0 and 2.0 wt. %
molybdenum between 0 and 1.0 wt. %
carbon between 0.1 and 0.6 wt. %

A preform typically is about 80 to 85 percent of theoretically density. After the powder has been made into a preformed shape, it may typically be sintered in order to increase the strength. Sintering of the metal preform (for example steel) requires temperatures in the range of about 2,000° to 2,300° F. for a time of about 2–30 minutes in a protective atmosphere. In one embodiment, such protective, non-oxidizing inert atmosphere is nitrogent-based. Subsequent to sintering, illustrated at 12, the preforms can be stored for later processing. Should such be the case, the preform is subsequently reheated to approximately 1950° F. in a protective atmosphere.

Next, the preforms, which are oversize in relation to the ultimate product, are assembled, as by placing two preforms in side-by-side relation. See for example the two preforms 31 and 32 in FIGS. 2 and 3*b* assembled along elongated interface 33, and forming sections of a single preform in the shape of a tool such as an adjustable wrench (for example) having a handle 34, and a head 35.

One or more of the segments of a part can be made from material that is fully dence, FIG. 1, item 11. Specialty materials, such as tungsten carbide, or threaded inserts can be bonded into the assembly.

Figure 3A:
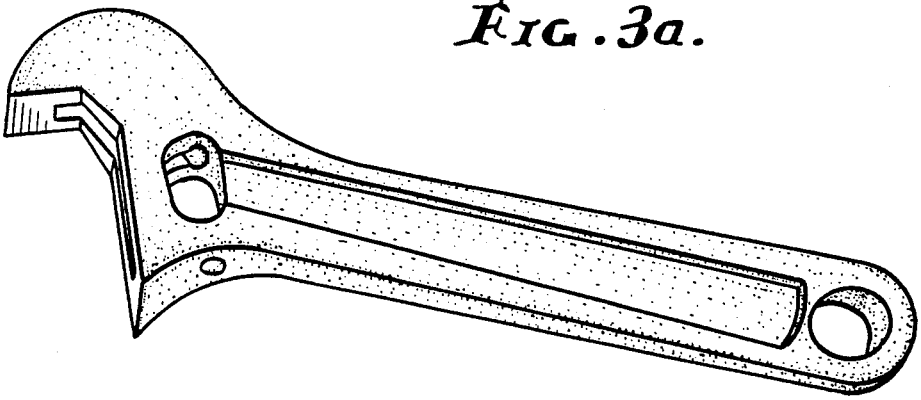
Figure 3B:
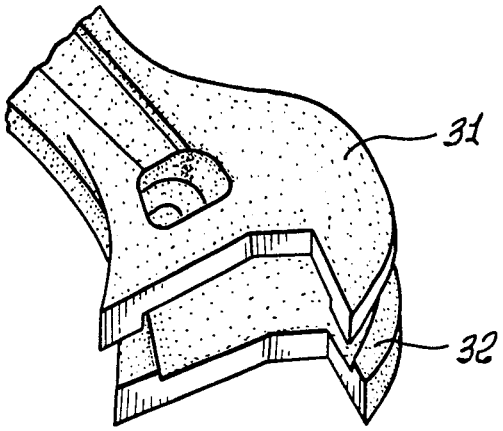

Next, the associated preforms are consolidated at elevated temperature and pressure to weld the sections 31 and 32 together, reducing them to ultimate part size, as depicted in FIGS. 3 and 3*a*. The consolidation process, illustrated at 16, and FIG. 4, typically takes place after the heated preforms have been placed in a bed of heated particles as hereinbelow discussed in greater detail. See also U.S. Pat. Nos. 3,689,258, 3,356,496, 4,501,718 and 4,499,049, and U.S. patent application Ser. No. 535,791, which are incorporated herein by reference. In order to generate a desired high quantity of production alternating layers or beds of heated particles and hot preforms can be used or multiple preforms are placed side-by-side in the bed of heated particles. Further, in order to speed up production, consolidation can take place subsequent to sintering, so long as the preforms are not permitted to cool. Consolidation takes place by subjecting the embedded preforms to high temperature and pressure. For metal (steel) objects, temperatures in the range of about 2000° F. and uniaxial pressures of about 25 TSI (tons per square inch) are used. Consolidation takes place for other metals and ceramics at pressures of 10–60 TSI, and temperature of 900° to 3500° F. depending on the material. The preform has now been densified and can be separated, as noted at 18, where the particles separate from the preform and can be recycled as indicated at 19. If necessary, any particles adhering to the preform can be easily removed and the final product can be further finished.

Referring now to FIG. 4 the consolidation step is more completely illustrated. The preform 20 has been completely immersed in a bed of ceramic or carbonaceous particles 22 as described, and which in turn have been placed in a contained zone 24*a* as in consolidation die 24. Press bed 26 forms a bottom platen, while hydraulic press ram 28 defines top and is used to press down onto the particles 22 which distributes the applied pressure substantially uniformly to preform 20. The preform and the bed of particles are at a temperature between 900° F. and 4000° F., prior to consolidation. This temperature is determined experimentally for each material. The embedded metal powder preform 20 is rapidly compressed under high psuedo-isostatic pressure by the action of ram 28 in die 24. FIG. 3 shows a consolidated article 20*a*.

FIGS. 2*a*–2*c* show various methods of joining the preforms in side-by-side relation prior to the consolidation step. In FIG. 2*a*, the preform 31 and 32 are joined by tack welding, indicated at 36; and in FIG. 2*b*, the preforms are mechanically joined as by a tongue and groove connections indicated at 37 and 38. In FIG. 2*c*, dry metal powder is placed in a thin layer 39 between the opposite sides of the preforms i.e. at the interface 33 indicated in FIG. 2. The powder then consolidates during step 16 to weld the consolidating preforms together. The powder may have the same composition as that of the preform, and the layer is between 0.001 and 0.005 inches thick, and may be in a volatile binder of fugitive organic type. Examples are cellulose acetate, butyl acetate, and stearates. The binder can be volatized as by drying for 3–24 hours at room temperature, or by baking in a near oxidizing atmosphere for several hours at 70°–300° F. The preforms may alternatively be otherwise adhesively bonded together, prior to consolidation.

A recess may be formed in one or both preforms, two opposing recesses in preform 31 and 32 being indicated at 40 and 41. Typically, and insert may be located in the recesses, as indicated at 42, the insert to be maintained therein during the consolidation step 16, as to provide a final recess of predetermined size. The insert is then removed after consolidation. Typical insert compositions include ceramics (such as quartz, zirconia and alumina) graphite, and refractory metals and alloys or cemented carbides. When the insert is smaller than the recesses, metal powder may be placed in the gap 43 between the recess walls and the insert, to consolidate in a layer and clad the recess walls, during the step 16. Such cladding may have the same composition as the preforms, or a different metallic composition so as to provide a bearing layer, for example. In this regard, the two preforms 31 and 32 may be different metallic compositions; and the insert 42 may be temporarily joined to one of the preforms and in the recess, prior to consolidations.

FIG. 1 also shows an additional step that comprises pre-consolidation at 20 of one or both preforms, i.e. prior to assembly at 14. The pre-consolidation step is typically carried out to press the preforms to between 75% and 85% of their ultimate densities achieved by step 16.

Referring now to FIGS. 5–9, the method of the invention is employed in the formation of a connecting rod 50. The preforms 51 for the connecting rod are alike, and have the shape as seen in FIG. 7, showing one symmetrical half of the FIG. 5, rod, viewed along line 7—7 of FIG. 5, such preforms being assembled or joined along the interface 52 (half the distance between opposite faces 53 of the connecting rod) in the same manner as described above in FIG. 2.

The preforms are initially cold pressed (using metallic steel powder for example) in the proper oversize dimensions, to about 80% of ultimate density of the connecting rod after consolidation. When place together, the two preform half sections 51 meet precisely, and are held together as shown in FIGS. 2*a*, or 2*b*, or a thin layer of metal powder and binder is placed at interface 52 as described above in FIG. 2*c*.

FIG. 10 is an end view of an assembled connecting rod. Inserts, as shown in FIG. 10 at 52, are placed in the cap bolt holes formed by the two halves of the connecting rod. Details of these inserts are the same as described for item 42, FIG. 2*d*.

The two half sections which have been assembled together are heated to the forging temperature of approximately 2000° F. and then placed in a grain bed, such grain being heated also to around 2000° F., and then consolidated to full density and welded together in a die, as per FIG. 4. During this process the two half sections are fully welded together in a fusion joint which exhibits no cast metal and essentially disappears.

The strength of this joint is 100% of the fully dense parent material of the alloy. In addition, the two half sections are consolidated to full 100% density for the alloy used. The form and shape of the connecting rod being now near-net-shape. Secondary operations for the connecting rod include, removal of the insert or inserts, sawing off the journal cap through 9—9, machining, heat treatment, finish grinding of bearing areas and threading the holes for journal cap bolts.

We claim:

1. The method of producing a metallic, ceramic, or metal ceramic, part, employing powdered material, that includes:

(a) forming two or more oversize powder material preforms respectively corresponding to two or more sections of the ultimate part to be produced, (b) placing said preforms in adjacent relation, and (c) consolidating said preforms at elevated temperature and pressure to weld said sections together and to reduce the sections to ultimate part size, (d) said consolidation step carried out by embedding said preforms in a grain bed, heated to about 2000° F., and pressurizing the grain to transmit consolidating force to the preforms.

2. The method of claim 1 including joining said preforms in said adjacent relation prior to said (c) step.

3. The method of claim 2 wherein said joining includes adhesively bonding said preforms.

4. The method of claim 2 wherein said joining includes mechanically interconnecting said preforms.

5. The method of claim 4 wherein said mechanical interconnecting includes providing tongue and groove interfitting of the preforms.

6. The method of claim 2 wherein said mechanical interconnecting includes tack welding of the preforms.

7. The method of claim 1 including placing dry metal or ceramic powder between sides of said preforms which are then placed together as per step (b) of claim 1.

8. The method of claim 7 wherein the powder is placed in a layer having thickness between 0.0001 and 0.005 inches.

9. The method of claim 1 wherein said (a) step includes forming a recess at the interface in at least one of the preforms and locating an insert in said recess, the insert maintained in said recess during said (c) step, and then removing the insert.

10. The method of claim 9 wherein the insert has a composition selected from the group that includes:

ceramic
graphite
refractory alloy or metal alloy
quartz
cemented carbide

11. The method of claim 10 wherein said ceramic is selected from the group that includes silica
zirconia
alumina
carbide
nitride

12. The method of claim 9 wherein said preforms are formed to be elongated and to have elongated sides, the recess having sections formed in both of said preforms, said (b) step carried out to register said recess sections.

13. The method of claim 12 wherein said recess extends through the two preforms placed together as per step (b) of claim 1, and including locating an insert in said recess prior to said step (c).

14. The method of claim 13 wherein said part comprise an elongated tool.

15. The method of claim 9 wherein said insert is smaller than said recess, and including placing powder metal or ceramic in the recess and about the insert to clad the recess walls during said (c) step.

16. The method of one of claims 9 and 15 including temporarily joining said insert to at least one of the preforms and in position in the recess, prior to said (c) step.

17. The method of claim 1 wherein said preforms respectively have different metallic or chemical compositions.

18. The method of claim 1 wherein said (b) step is preceeded by sintering or pre-consolidating said preforms at elevated temperature to partially reduce their sizes.

19. The method of claim 18 wherein said sintering or pre-consolidation step is carried out to densify the preforms to between 75% and 85% of their ultimate densities achieved by said (c) step.

20. The method of claim 18 wherein said (c) step is carried out at preform temperature of about 2000° F.

21. The method of claim 1 wherein the grain consists of material selected from the group consisting essentially of spherical, carbonaceous or ceramic particles, and is at about 2000° F. during said (c) step.

22. The method of claim 18 wherein said preforms have composition consisting of iron alloyed with nickle, carbon and molybdenum.

23. The method of claim 18 wherein said ultimate part has H-shaped cross section.

24. The method of claim 23 wherein said part comprises a connecting rod.

25. The method of claim 18 including placing dry metal powder between sides of said preforms which are then placed together as per step (b) of claim 1.

26. The method of claim 18 wherein said (a) step includes forming a recess in at least one of the preforms and locating an insert in said recess, the insert maintained in said recess during said (c) step, and then removing the insert.

27. The method of claim 26 wherein said preforms are formed to be elongated and to have elongated sides, the recess having sections formed in both of said preforms, said (b) step carried out to register said recess sections.

28. The method of one of claims 1–15, 17–20 and 21 wherein one or more of the sections of the final part is or are formed to consist of a fully dense metal, metal-ceramic, or ceramic composition.

29. The method of producing a metallic, ceramic, or metal ceramic, part, employing powdered material, that includes:

(a) forming two or more oversize powder material preforms respectively corresponding to two or more sections of the ultimate part to be produced, (b) placing said preforms in adjacent relation, and (c) consolidating said preforms at elevated temperature and pressure to weld said sections together and to reduce the sections to ultimate part size, (d) said consolidation step carried out by embedding said preforms in a grain bed, and pressurizing the grain to transmit consolidating force to the preforms, the temperatures of the grain bed and of the preforms prior to consolidation being between 900° F. and 4000° F.

* * * * *